US009150031B2

(12) United States Patent
Fujimoto

(10) Patent No.: US 9,150,031 B2
(45) Date of Patent: Oct. 6, 2015

(54) PRINTING MACHINE FOR PRINT UNITS HAVING DIFFERENT PRINTING PATTERNS AND DIFFERENT SHEET SIZES

(71) Applicant: RISO KAGAKU CORPORATION, Tokyo (JP)

(72) Inventor: Masatoshi Fujimoto, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/184,835

(22) Filed: Feb. 20, 2014

(65) Prior Publication Data

US 2014/0240381 A1 Aug. 28, 2014

(30) Foreign Application Priority Data

Feb. 27, 2013 (JP) ..... 2013-037089

(51) Int. Cl.

*B41J 29/38* (2006.01)
*B41J 3/60* (2006.01)
*B41J 13/00* (2006.01)

(52) U.S. Cl.

CPC ..... *B41J 3/60* (2013.01); *B41J 13/0009* (2013.01)

(58) Field of Classification Search

None
See application file for complete search history.

(56) References Cited

U.S. PATENT DOCUMENTS

2010/0129094 A1* 5/2010 Maeda et al. ..... 399/38
2011/0280643 A1* 11/2011 Matsumoto et al. ..... 400/582

FOREIGN PATENT DOCUMENTS

JP 2006-256138 A 9/2006
JP 2006256138 A * 9/2006

* cited by examiner

*Primary Examiner* — Stephen Meier
*Assistant Examiner* — Bradley Thies
(74) *Attorney, Agent, or Firm* — Greenblum & Bernstein P.L.C.

(57) ABSTRACT

A controller is configured to: when printing of a plurality of print units each including a plurality of categories of sheets having different sizes is performed on a unit-by-unit basis, control a feed timing of each sheet by a paper feed unit and a transport of the sheets by a transport unit according to a transport control pattern corresponding to a printing pattern including a combination of one-side/double-side printing settings for the respective categories of sheets in each of the print units; and when the printing of the plurality of print units is consecutively performed and when a predetermined condition is satisfied, arrange an order of printing of the plurality of print units such that the print units having a same printing pattern among the plurality of print units are successively printed.

11 Claims, 8 Drawing Sheets

PRINTING MACHINE FOR PRINT UNITS HAVING DIFFERENT PRINTING PATTERNS AND DIFFERENT SHEET SIZES

CROSS REFERENCE TO RELATED APPLICATION

This application is based upon and claims the benefit of priority from the prior Japanese Patent Application No. 2013-037089, filed on Feb. 27, 2013, the entire contents of which are incorporated herein by reference.

BACKGROUND

1. Technical Field

The present invention relates to a printing machine for printing on paper.

2. Related Art

Japanese Patent Application Publication No. 2006-256138 discloses a printing machine which has a circulating route including a reversing route configured to reverse paper and which performs double-side printing by transporting paper printed on one side thereof along the circulating route to reverse the sides of the paper and printing the paper on the other side thereof.

Moreover, a sealed letter formation system has been known in which an enclosing and sealing device is connected to a printing machine such as described above. In this sealed letter formation system, for each sealed letter to be formed, the printing machine performs printing on content paper and envelope paper, and the printed content paper and envelope paper are sent to the enclosing and sealing device. The enclosing and sealing device forms the printed envelope paper into an envelope, and seals the envelope having the printed content paper inserted therein, thus forming a sealed letter.

In the above-described sealed letter formation system, generally, the sizes of content paper and envelope paper are different from each other. Moreover, one-side printing or double-side printing can be set for each of content paper and envelope paper. Specifically, in the printing machine of this sealed letter formation system, control is performed to feed and transport content paper and envelope paper having different sizes, and further, performs four types of control of paper feed and transport according to combinations of one-side/double-side printing settings for content paper and envelope paper. Here, there are four combinations of one-side/double-side printing settings: both of content paper and envelope paper are subject to one-side printing; content paper is subject to one-side printing, and envelope paper is subject to double-side printing; content paper is subject to double-side printing, and envelope paper is subject to one-side printing; and both of content paper and envelope paper are subject to double-side printing.

In the printing machine of the above-described sealed letter formation system, paper feed and transport are controlled according to transport control patterns corresponding to the respective four combinations of one-side/double-side printing settings to perform high productivity printing.

SUMMARY

In the printing machine of the above-described sealed letter formation system, in the case where combinations of one-side/double-side printing settings for content paper and envelope paper are different between a letter to be printed first and a letter to be printed next, transport control patterns need to be switched therebetween. In the case where transport control patterns are switched between letters, the control of paper feed and transport is started again. Accordingly, after all of sheets for the preceding letter are sent out to the enclosing and sealing device, the feed of sheets for the subsequent letter is started. As a result, in the printing machine, the switching of transport control patterns causes a decrease in printed matter productivity.

An object of the present invention is to provide a printing machine which can reduce a decrease in printed matter productivity.

A printing machine in accordance with some embodiments includes: a transport unit configured to transport a sheet along a circulating route including a reversing route; a paper feed unit configured to feed the sheet to the circulating route; a printing unit configured to perform printing on the sheet transported along the circulating route; a paper discharge unit configured to discharge the sheet from the circulating route; and a controller configured to control the transport unit, the paper feed unit, the printing unit, and the paper discharge unit in response to a print job. The controller is configured to perform control such that: for a sheet subject to one-side printing, the sheet is printed on one side thereof by the printing unit while being transported by the transport unit and then discharged by the paper discharge unit without entering the reversing route; and for a sheet subject to double-side printing, the paper is printed on one side thereof by the printing unit while being transported by the transport unit, then reversed on the reversing route, printed on the other side thereof by the printing unit, and then discharged by the paper discharge unit. The controller is further configured to: when printing of a plurality of print units each including a plurality of categories of sheets having different sizes is performed on a unit-by-unit basis, control a feed timing of each sheet by the paper feed unit and a transport of the sheets by the transport unit according to a transport control pattern corresponding to a printing pattern including a combination of one-side/double-side printing settings for the respective categories of sheets in each of the print units; and when the printing of the plurality of print units is consecutively performed and when a predetermined condition is satisfied, arrange an order of printing of the plurality of print units such that the print units having a same printing pattern among the plurality of print units are successively printed.

In the above-described configuration, in the case where printing of a plurality of print units is consecutively performed, the controller arranges the order of printing such that print units having the same printing pattern are successively printed. This can reduce the number of times of the switching of transport control patterns. As a result, printed matter productivity can be improved.

The printing unit may include an inkjet head configured to eject ink droplets onto the sheet to be transported. The printing pattern may include paper types for the respective categories of sheets in each of the print units. The controller may be configured to control a maximum number of the ink droplets per pixel to be ejected from the inkjet head onto the sheet and control a transport speed of the sheet by the printing unit during printing, according to the paper type of the sheet.

In the above-described configuration, the printing unit includes an inkjet head configured to eject ink droplets onto a sheet which is being transported, and the controller makes printing patterns include combinations of types of the respective categories of paper. This can reduce a decrease in the productivity of the inkjet printing machine with print quality maintained according to different paper types.

When the printing of the plurality of print units is consecutively performed and when the predetermined condition is not satisfied, the controller may be configured to arrange the order of printing of the plurality of print units such that the plurality of print units are printed in order from the print unit in a topmost position in an order in which the plurality of print units are arranged in the print job.

In the above-described configuration, in the case where the effect of processing time required for the switching of transport control patterns on productivity is relatively small, sealed letters can be formed in the order in which the letters are arranged in a print job.

The predetermined condition may be that a number of the plurality of print units is larger than a reference value.

In the above-described configuration, in the case of the printing of a small number of letters in which the effect of processing time required for the switching of transport control patterns on productivity is relatively small, sealed letters can be formed in the order in which the letters are arranged in a print job.

There may be no predetermined condition.

With the above-described configuration, the number of times of the switching of transport control patterns can be reduced. As a result, printed matter productivity can be improved.

DETAILED DESCRIPTION

Figure 1:
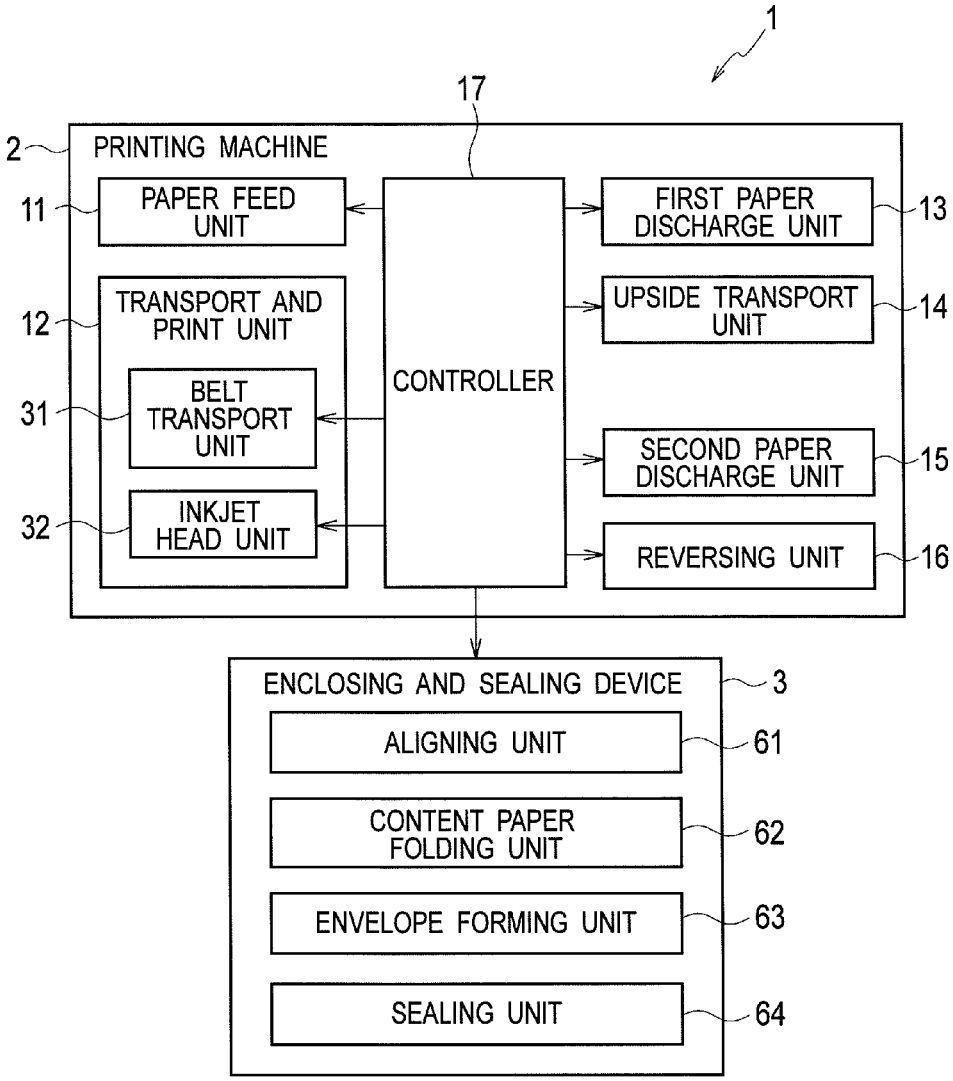
FIG. 1 is a block diagram showing the configuration of a sealed letter formation system including a printing machine according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinafter, an embodiment of the present invention will be described with reference to the drawings. In the drawings, the same or similar portions and components are denoted by the same or similar reference numerals. It should be noted, however, that the drawings are schematic and different from reality. Moreover, it is a matter of course that the drawings may include portions in which dimensional relationships or proportions are different between drawings. It should be noted that in FIG. 2, RT, LT, UP, and DN mean right, left, up, and down, respectively.

Figure 2:
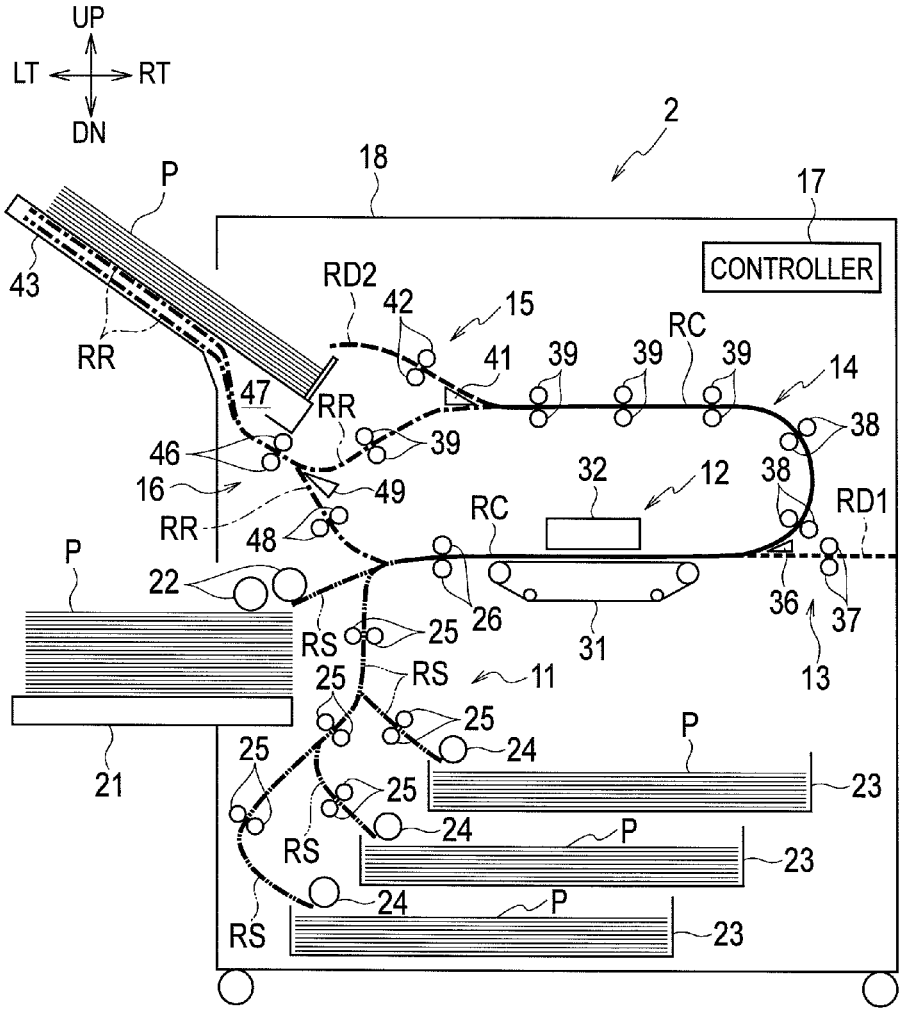
FIG. 2 is a schematic configuration diagram of the printing machine.

FIG. 1 is a block diagram showing the configuration of a sealed letter formation system including a printing machine according to an embodiment of the present invention. FIG. 2 is a schematic configuration diagram of the printing machine. In the description below, the direction of the front of the drawing of FIG. 2, in which a user is positioned, is defined as front. Moreover, as shown in FIG. 2, up, down, right, and left directions as seen by the user are defined as up, down, right, and left directions.

As shown in FIG. 1, a sealed letter formation system 1 according to this embodiment includes a printing machine 2 and an enclosing and sealing device 3.

The printing machine 2 performs printing on paper P. As shown in FIGS. 1 and 2, the printing machine 2 includes a paper feed unit 11, a transport and print unit 12, a first paper discharge unit 13, an upside transport unit 14, a second paper discharge unit 15, a reversing unit 16, a controller 17, and a casing 18 for housing or holding each component.

In FIG. 2, routes represented by bold lines are transport routes along which paper P is transported. Of the transport routes, the route represented by a solid line is a common route RC, the route represented by a dashed dotted line is a reversing route RR, the route represented by a short broken line is a first paper discharge route RD1, the route represented by a long broken line is a second paper discharge route RD2, and the route represented by a two-dot chain line is a paper supply route RS. The common route RC and the reversing route RR constitute a circulating route. The words upstream and downstream in the description below mean upstream and downstream of a transport route, respectively.

The paper feed unit 11 feeds paper P to the common route RC. The paper feed unit 11 is disposed at the upstream end of the transport routes. The paper feed unit 11 includes an external paper feed tray 21, external paper feed rollers 22, plural internal paper feed trays 23, plural internal paper feed rollers 24, plural pairs of vertical transport rollers 25, and registration rollers 26.

The external paper feed tray 21 is configured to hold a stack of paper P as a print medium. The external paper feed tray 21 is installed such that part thereof is exposed outside the casing 18.

The external paper feed rollers 22 pick up sheets of paper P one by one from the external paper feed tray 21 and transport the paper P toward the undermentioned registration rollers 26 along the paper supply route RS. The external paper feed rollers 22 are disposed above the external paper feed tray 21. The external paper feed rollers 22 are driven by an unillustrated motor.

Each of the internal paper feed trays 23 is configured to hold a stack of paper P as a print medium. The internal paper feed trays 23 are disposed inside the casing 18.

The internal paper feed rollers 24 pick up sheets of paper P one by one from the internal paper feed trays 23 and send the paper P into the paper supply route RS. The internal paper feed rollers 24 are provided above the internal paper feed trays 23, respectively. The internal paper feed rollers 24 are driven by an unillustrated motor.

The vertical transport rollers 25 transport the paper P picked up from the internal paper feed trays 23 toward the registration rollers 26. The vertical transport rollers 25 are disposed along the paper supply route RS. The vertical transport rollers 25 are driven by an unillustrated motor.

The registration rollers 26 stops paper P transported from the external paper feed rollers 22, the vertical transport rollers 25, or undermentioned paper re-feed rollers 48 once, and then transports the paper P toward an undermentioned belt transport unit 31. The registration rollers 26 are disposed in the vicinity of a junction of the paper supply route RS and the reversing route RR on the common route RC. The registration rollers 26 are driven by an unillustrated motor. The registration rollers 26 also function as part of the transport unit.

The transport and print unit 12 prints an image on paper P while transporting the paper P. The transport and print unit 12 is disposed downstream of the paper feed unit 11. The transport and print unit 12 includes a belt transport unit 31 and an inkjet head unit 32.

The belt transport unit 31 transports paper P transported from the registration rollers 26 while holding by suction the paper P onto a belt. The belt transport unit 31 is disposed downstream of the registration rollers 26. The belt transport unit 31 is driven by an unillustrated motor. The belt transport unit 31 constitutes part of the transport unit.

The inkjet head unit 32 includes plural line-type inkjet heads each having plural nozzles arranged in a direction (front-back direction) approximately perpendicular to the direction of transport of paper P. The inkjet head unit 32 is disposed above the belt transport unit 31. The inkjet head unit 32 prints an image on paper P which is being transported by the belt transport unit 31, by ejecting ink droplets from the inkjet heads. The inkjet head unit 32 corresponds to the printing unit.

The first paper discharge unit 13 discharges (sends out) printed paper P to the enclosing and sealing device 3 in printing for sealed letter formation. The first paper discharge unit 13 includes a switching unit 36 and first paper discharge rollers 37.

The switching unit 36 switches the transport route of paper P between the common route RC and the first paper discharge route RD1. The switching unit 36 is disposed at a point where the common route RC and the first paper discharge route RD1 branch off. The switching unit 36 is driven by an unillustrated solenoid. The first paper discharge route RD1 is a route extending from the boundary between the transport and print unit 12 and the upside transport unit 14 to the right toward the enclosing and sealing device 3. The downstream end of the first paper discharge route RD1 is connected to the upstream end of an entrance route to the enclosing and sealing device 3.

The first paper discharge rollers 37 transport paper P transported from the belt transport unit 31 and send out the paper P to the enclosing and sealing device 3. The first paper discharge rollers 37 are disposed downstream of the switching unit 36 along the first paper discharge route RD1. The first paper discharge rollers 37 are driven by an unillustrated motor.

The upside transport unit 14 transports paper P transported from the belt transport unit 31 to the right and then to the left such that the paper P makes a U turn. The upside transport unit 14 constitutes part of the transport unit. The upside transport unit 14 includes plural pairs of upward transport rollers 38 and plural pairs of horizontal transport rollers 39.

The upward transport rollers 38 transport paper P to the horizontal transport rollers 39 above the upward transport rollers 38 while nipping the paper P. The upward transport rollers 38 are disposed along the common route RC. The common route RC in a region in which the upward transport rollers 38 are disposed has a semicircular shape which is open to the left. The upward transport rollers 38 are driven by an unillustrated motor.

The horizontal transport rollers 39 transport paper P to the second paper discharge unit 15 or the reversing unit 16 while nipping the paper P. The most downstream horizontal transport rollers 39 are disposed upstream of the reversing route RR. The other horizontal transport rollers 39 are disposed along a horizontal portion in a downstream part of the common route RC. The horizontal transport rollers 39 are driven by an unillustrated motor.

The second paper discharge unit 15 discharges printed paper P. The second paper discharge unit 15 includes a switching unit 41, second paper discharge rollers 42, and a paper receiving tray 43.

The switching unit 41 switches the transport route of paper P between the second paper discharge route RD2 and the reversing route RR. The switching unit 41 is disposed at a point where the second paper discharge route RD2 and the reversing route RR branch off. The switching unit 41 is driven by an unillustrated solenoid.

The second paper discharge rollers 42 transport paper P guided to the second paper discharge route RD2 by the switching unit 41 to discharge the paper P to the paper receiving tray 43. The second paper discharge rollers 42 are disposed along the second paper discharge route RD2 between the switching unit 41 and the paper receiving tray 43. The second paper discharge rollers 42 are driven by an unillustrated motor.

The paper receiving tray 43 is configured to hold a stack of discharged paper P. The paper receiving tray 43 is disposed at the downstream end of the second paper discharge route RD2.

The reversing unit 16, in double-side printing, reverses paper P printed on one side thereof and transports the paper P to the registration rollers 26. The reversing unit 16 constitutes part of the transport unit. The reversing unit 16 includes reversing rollers 46, a switchback unit 47, the paper re-feed rollers 48, and a switching gate 49.

The reversing rollers 46 temporarily carry paper P transported from the upside transport unit 14, into the switchback unit 47, and then move the paper P out to transport the paper P to the paper re-feed rollers 48. The reversing rollers 46 are disposed on the reversing route RR between the most downstream pair of horizontal transport rollers 39 and an entrance to the switchback unit 47. The reversing rollers 46 are driven by an unillustrated motor.

The switchback unit 47 is a space into which the reversing rollers 46 temporarily carry paper P. The switchback unit 47 is formed in a lower portion of the paper receiving tray 43. The switchback unit 47 has an opening in the vicinity of the reversing rollers 46 such that paper P is carried into the switchback unit 47.

The paper re-feed rollers 48 transport paper P transported from the reversing rollers 46, to the registration rollers 26. The paper re-feed rollers 48 are disposed on the reversing route RR between the reversing rollers 46 and the registration rollers 26. The paper re-feed rollers 48 are driven by an unillustrated motor.

The switching gate 49 guides paper P transported from the horizontal transport rollers 39, to the reversing rollers 46. Moreover, the switching gate 49 guides paper P to be moved out of the switchback unit 47 by the reversing rollers 46, to the paper re-feed rollers 48. The switching gate 49 is disposed in the vicinity of the centroid of three points corresponding to the most downstream pair of horizontal transport rollers 39, the reversing rollers 46, and the paper re-feed rollers 48.

The controller 17 controls the operation of the entire printing machine 2. Moreover, the controller 17 controls the operation of the entire enclosing and sealing device 3. The controller 17 is configured to include a CPU, a RAM, a ROM, a hard disk drive, and the like.

Specifically, for paper P to be printed on one side thereof, the controller 17 performs control such that the paper P is printed by the inkjet head unit 32 during the transportation thereof along the common route RC and then discharged without entering the reversing route RR; and, for paper P to be printed on both sides thereof, the controller 17 performs control such that the paper P is printed on one side thereof by the inkjet head unit 32 during the transportation thereof along the common route RC, reversed on the reversing route RR, printed on the other side thereof by the inkjet head unit 32, and then discharged. Here, in the case of printing for sealed letter formation, the controller 17 causes the first paper discharge unit 13 to discharge (send out) the paper P printed on one side or both sides thereof to the enclosing and sealing device 3; and, in the case of printing not for sealed letter formation, the controller 17 causes the second paper discharge unit 15 to discharge the paper P to the paper receiving tray 43.

In printing for sealed letter formation, the controller 17 controls the timing of the feed of each sheet of paper P by the paper feed unit 11 and the transport of the paper P along the circulating route (common route RC and reversing route RR) according to a transport control pattern corresponding to a printing pattern.

A printing pattern is a pattern of the combination of one-side/double-side printing settings for content paper and envelope paper. There are four printing patterns: both of content paper and envelope paper are subject to one-side printing (one-side-one-side pattern); content paper is subject to one-side printing, and envelope paper is subject to double-side printing (one-side-double-side pattern); content paper is subject to double-side printing, and envelope paper is subject to one-side printing (double-side-one-side pattern); and both of content paper and envelope paper are subject to double-side printing (double-side-double-side pattern). Transport control patterns corresponding to the respective printing patterns will be described later. In printing for sealed letter formation, in the case where the printing of plural letters is consecutively performed, the controller 17 arranges the order of printing such that letters having the same printing pattern are successively printed.

Here, envelope paper is paper dedicated for sealed letter formation by the enclosing and sealing device 3. Envelope paper has remoistenable adhesive, which is activated when moistened with water, and pressure sensitive adhesive, which forms a bond on contact under pressure, previously applied to predetermined positions thereon. As content paper, ordinary paper or the like is used. The sizes of envelope paper and content paper are different from each other.

The enclosing and sealing device 3 forms envelope paper printed by the printing machine 2 into an envelope, and inserts content paper printed by the printing machine 2 into the envelope to form a sealed letter. As shown in FIG. 1, the enclosing and sealing device 3 includes a aligning unit 61, a content paper folding unit 62, an envelope forming unit 63, and a sealing unit 64.

The aligning unit 61 stacks and aligns sheets of printed content paper sent from the printing machine 2, for each of the number of sheets corresponding to a single letter.

The content paper folding unit 62 folds the sheets of content paper aligned by the aligning unit 61, into two sections, three sections, or the like.

The envelope forming unit 63 forms printed envelope paper sent from the printing machine 2 into an envelope, and inserts content paper into the envelope. The envelope forming unit 63 applies water to the remoistenable adhesive provided at predetermined positions on the envelope paper, and folds the envelope paper to bond facing surfaces at the predetermined positions, thus forming an envelope.

The sealing unit 64 seals the envelope which is formed by the envelope forming unit 63 to contain the content paper, thus completing a sealed letter. The sealing unit 64 seals the envelope by bonding portions of the pressure sensitive adhesive on the envelope to each other by the application of pressure.

Next, the operation of the sealed letter formation system 1 will be described.

First, one-side printing and double-side printing in the printing machine 2 will be described.

When one-side printing is started, paper P is transported from the paper feed unit 11 to the transport and print unit 12. In the transport and print unit 12, the paper P is printed using ink ejected from the inkjet head unit 32 while being transported by the belt transport unit 31.

In the case of one-side printing for sealed letter formation, paper P printed on one side thereof is guided from the common route RC to the first paper discharge route RD1 by the switching unit 36. Then, the paper P is sent to the enclosing and sealing device 3 by the first paper discharge rollers 37.

In the case of one-side printing not for sealed letter formation, paper P printed on one side thereof is guided to the upside transport unit 14 by the switching unit 36. In the upside transport unit 14, the paper P is transported to the switching unit 41 by the upward transport rollers 38 and the horizontal transport rollers 39, and guided from the common route RC to the second paper discharge route RD2 by the switching unit 41. Further, the paper P is discharged to the paper receiving tray 43 by the second paper discharge rollers 42.

In the case of double-side printing, paper P fed and printed on a front side (side to be printed first) thereof by the transport and print unit 12 is guided to the upside transport unit 14 by the switching unit 36. In the upside transport unit 14, the paper P is transported to the switching unit 41 by the upward transport rollers 38 and the horizontal transport rollers 39, and guided from the common route RC to the reversing route RR by the switching unit 41. In the reversing unit 16, the paper P guided to the reversing route RR is guided to the reversing rollers 46 by the switching gate 49, and carried into the switchback unit 47 by the reversing rollers 46. After that, the paper P is moved out of the switchback unit 47 by the reversing rollers 46 and guided to the paper re-feed rollers 48 by the switching gate 49 to be transported to the registration rollers 26 by the paper re-feed rollers 48. Then, the paper P is transported to the belt transport unit 31 by the registration rollers 26. Here, since the paper P is reversed by the reversing unit 16, a back side (side to be printed later) thereof is faced up. Thus, the paper P is printed on the back side thereof using ink ejected from the inkjet head unit 32 while being transported by the belt transport unit 31.

In the case of double-side printing for sealed letter formation, the paper P printed on both sides thereof is, as in the case of the above-described one-side printing for sealed letter formation, guided from the common route RC to the first paper discharge route RD1 by the switching unit 36 and sent to the enclosing and sealing device 3 by the first paper discharge rollers 37.

In the case of double-side printing not for sealed letter formation, the paper P printed on both sides thereof is, as in the case of the above-described one-side printing not for sealed letter formation, transported by the upward transport rollers 38 and the horizontal transport rollers 39 and then discharged to the paper receiving tray 43 by the second paper discharge rollers 42.

In the case where the printing machine 2 performs the printing of plural sheets of paper, sheets of paper P are sequentially fed from the paper feed unit 11, and plural sheets of paper P are simultaneously transported on the transport route. The control of paper feed and transport in such printing of plural sheets of paper will be described.

First, the control of paper feed and transport in the printing of plural sheets of paper not for sealed letter formation will be described. Here, all of the sizes of sheets of paper P to be printed are assumed to be the same.

Figure 3:
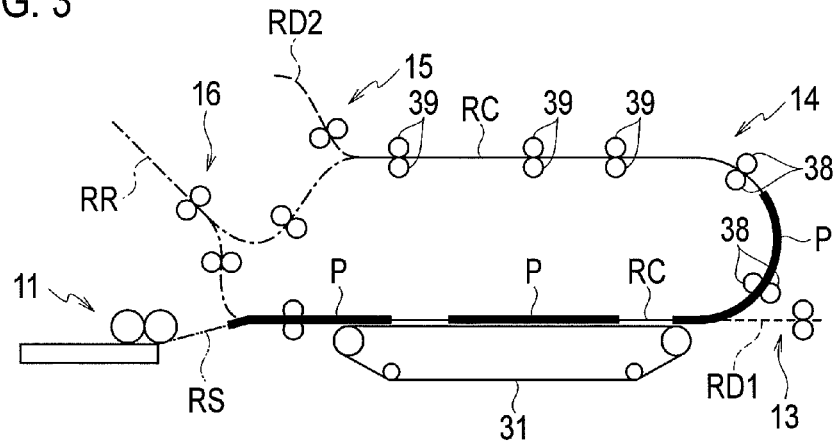
FIG. 3 is a view showing sheet transport in the one-side printing of plural sheets.

In the case of the one-side printing of plural sheets of paper, as shown in FIG. 3, plural sheets of paper P are fed from the paper feed unit 11 with such timings that the sheets of paper P are transported with predetermined sheet intervals maintained therebetween, and are transported. Here, a sheet interval means the distance between a trailing edge of a leading sheet and a leading edge of a trailing sheet.

Figure 4:
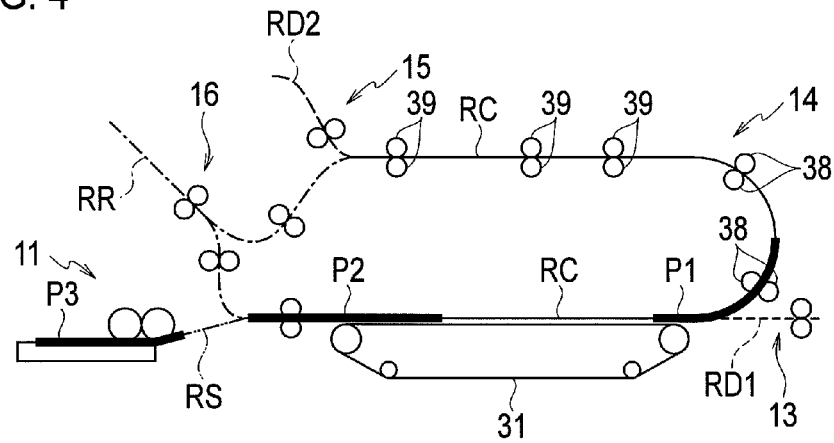
FIG. 4 is a view showing sheet transport in the double-side printing of plural sheets.

In the case of the double-side printing of plural sheets of paper, sheets of paper are fed from the paper feed unit 11 with such timings that the timings corresponding to every other sheet fed in the above-described one-side printing are skipped. Accordingly, as shown in FIG. 4, after a first sheet P1 is fed, a second sheet P2 is fed with a sheet interval not less than the length of a single sheet.

Figure 5:
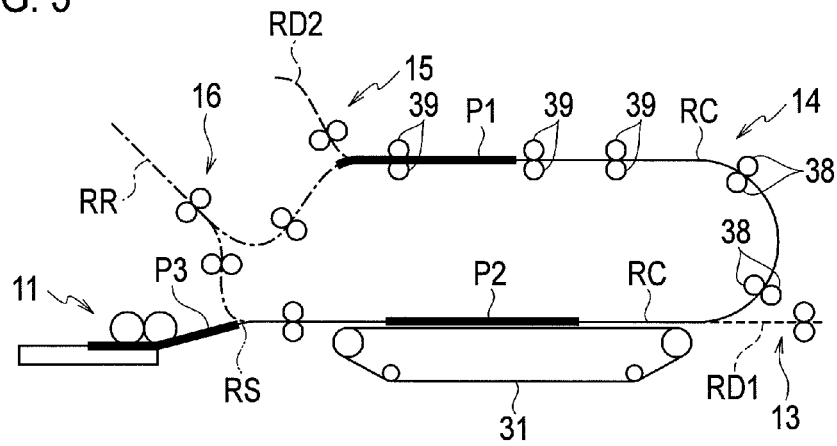
FIG. 5 is a view showing sheet transport in the double-side printing of plural sheets.

The transport speed of the horizontal transport rollers 39 is set to a speed higher than the transport speeds of the belt transport unit 31 and the upward transport rollers 38. This increases the sheet interval between the first sheet P1 which is being transported by the horizontal transport rollers 39 and the second sheet P2 which is being transported by the belt transport unit 31, as shown in FIG. 5. Here, the belt transport unit 31 transports a sheet P at a predetermined printing transport speed. Since the transport speed cannot be changed until the sheet P leaves the belt transport unit 31, the upward transport rollers 38 also transports the sheet P at the same transport speed as the belt transport unit 31.

Figure 6:
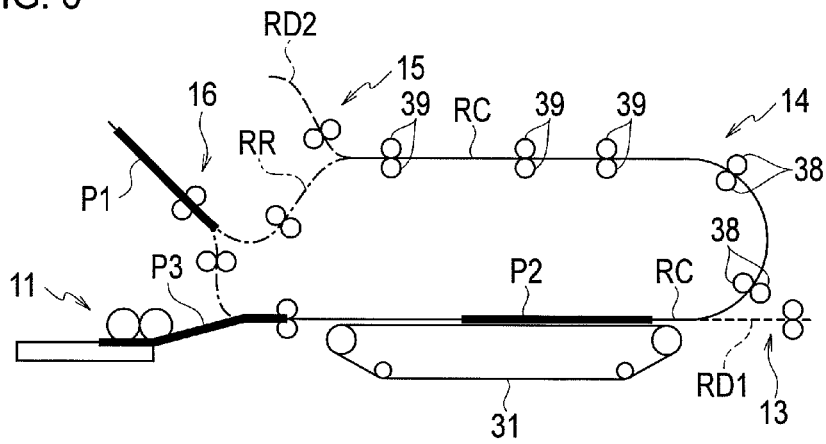
FIG. 6 is a view showing sheet transport in the double-side printing of plural sheets.
Figure 7:
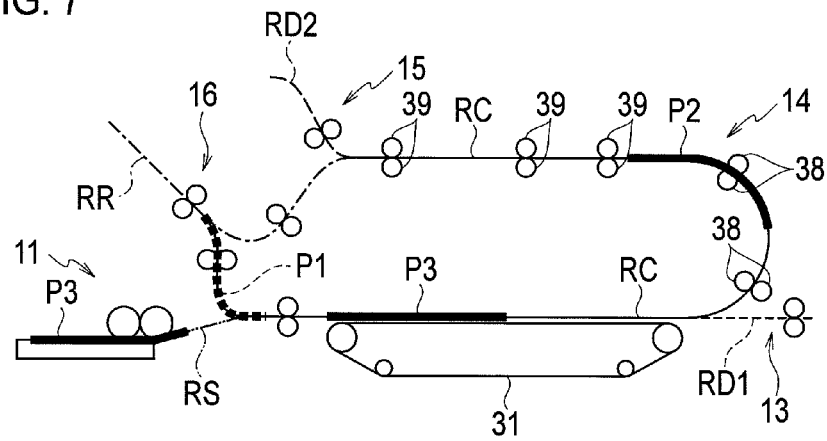
FIG. 7 is a view showing sheet transport in the double-side printing of plural sheets.
Figure 8:
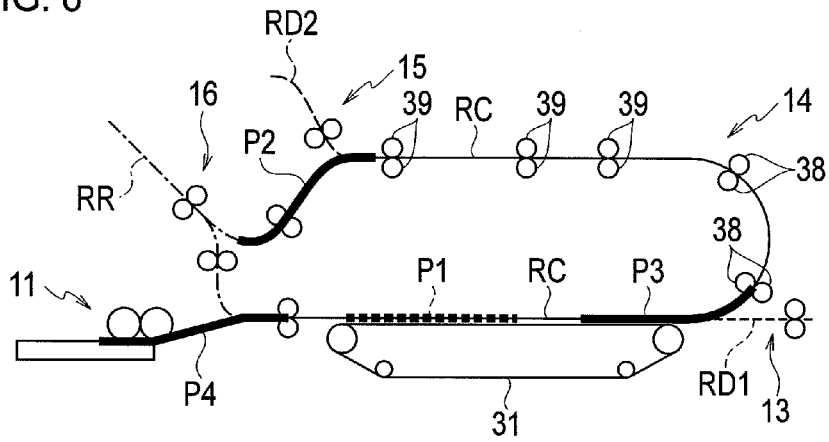
FIG. 8 is a view showing sheet transport in the double-side printing of plural sheets.

The transport speed of the horizontal transport rollers 39 is set to such a speed that a reversed sheet P can be re-fed with a predetermined timing. Specifically, the transport speed of the horizontal transport rollers 39 is set such that a first sheet P1 reversed on the reversing route RR as shown in FIG. 6 can be re-fed between third and fourth fed sheets P3 and P4 as shown in FIGS. 7 and 8.

Moreover, the feed and transport of each sheet are controlled such that the sheet interval between the sheet P3 to be printed on a front side thereof and the sheet P1 to be printed on a back side thereof and the sheet interval between the sheet P1 to be printed on the back side thereof and the sheet P4 to be printed on a front side thereof may be the same as those in the aforementioned one-side printing.

Figure 9:
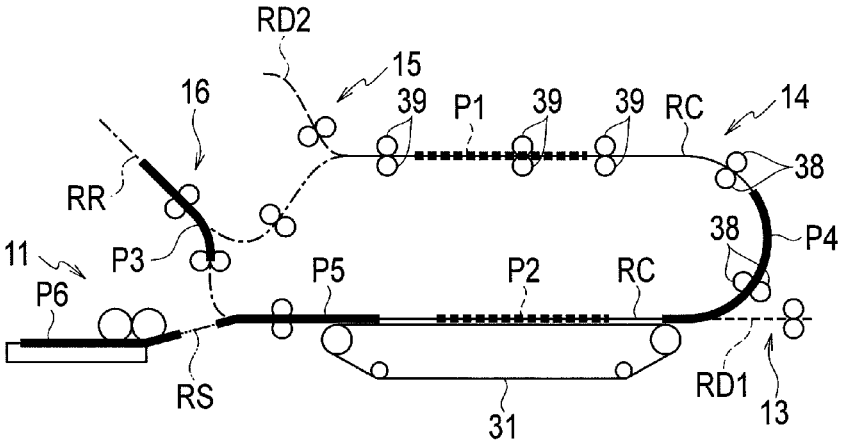
FIG. 9 is a view showing sheet transport in the double-side printing of plural sheets.

After that, as shown in FIG. 9, the second sheet P2 to be printed on a back side thereof is re-fed between fourth and fifth sheets P4 and P5 to be printed on front sides thereof. Here, reversed sheets P are represented by bold broken lines.

The above-described paper feed and transport such as shown in FIGS. 4 to 9 are repeated. Thus, printing is performed in the order and with the timings shown in FIG. 10. Here, the sheets hatched with dots are reversed sheets to be printed on back sides thereof. Further, a number written in each sheet indicates the position of the sheet in the order of feed.

Figure 10:
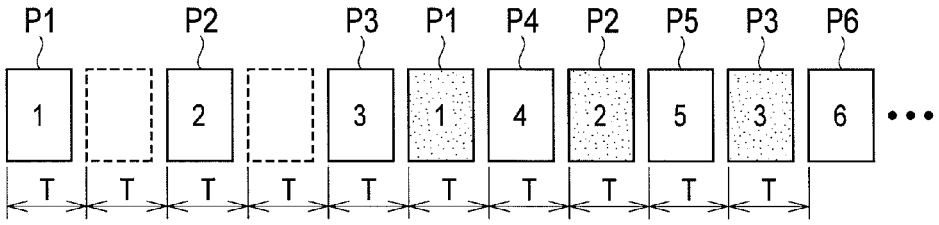
FIG. 10 is a view for explaining the order and timings of printing in the double-side printing of plural sheets.

As shown in FIG. 10, in the double-side printing of plural sheets, after the first sheet P1 is printed on the front side thereof, the second sheet P2 is printed on the front side thereof after a pause equal to printing time T for a single sheet, and then the third sheet P3 is printed on the front side thereof after another pause equal to printing time T for a single sheet. Subsequently, the first sheet P1 circulated and reversed is printed on the back side thereof. After that, the fourth sheet P4 is printed on the front side thereof, and then the second sheet P2 circulated and reversed is printed on the back side thereof. After that, similarly, the printing of a front side of a newly fed sheet P and the printing of a back side of a circulated and reversed sheet P are alternately performed. It should be noted, however, that at the end of printing, newly feeding a sheet P is finished, three circulated and reversed sheets P are successively printed on back sides thereof with pauses equal to printing time T provided therebetween, and printing is finished.

Here, printing time T has a value obtained by dividing the distance obtained by adding the length of a sheet P measured in the transport direction to the sheet interval with the printing transport speed of the belt transport unit 31. The above-described double-side printing has the same printing time T as one-side printing. Thus, double-side printing is performed with productivity per side equivalent to that in one-side printing.

Next, the control of paper feed and transport in printing for sealed letter formation will be described.

Printing for sealed letter formation is performed for each sealed letter to be formed on a letter-by-letter basis. Sheets for forming a single sealed letter are plural sheets including one or more sheets of content paper and one sheet of envelope paper. After the content paper is printed, the envelope paper is printed. Sheets of the content paper and sheets of the envelope paper have different sizes. Generally, sheets of the envelope paper are larger than sheets of the content paper. Moreover, for each of the content paper and the envelope paper, one-side printing or double-side printing is selected.

The aforementioned control of paper feed and transport in the printing of plural sheets not for sealed letter formation is applied to cases where plural sheets P having the same size are printed on one sides thereof and cases where plural sheets P having the same size are printed on both sides thereof. In the case where plural sheets include both of a sheet to be printed on one side thereof and a sheet to be printed on both sides thereof as in printing for sealed letter formation, when switching between one-side printing and double-side printing is performed, all sheets P on the transport route are discharged, and then a next sheet is fed. Moreover, in the case of the double-side printing of plural sheets having two or more different paper sizes as in printing for sealed letter formation, when paper sizes are switched, all sheets P on the transport route are discharged, and then a next sheet is fed. This reduces productivity.

Accordingly, to realize high productivity in printing for sealed letter formation, in this embodiment, the control of paper feed and transport is performed according to a transport control pattern corresponding to a printing pattern of printing for sealed letter formation. As described previously, there are four printing patterns: one-side-one-side pattern, one-side-double-side pattern, double-side-one-side pattern, and double-side-double-side pattern.

Each of transport control patterns corresponding to the respective printing patterns will be described. It should be noted that in this embodiment, the same content paper and the same envelope paper are assumed to be used for all letters. Specifically, all sheets of content paper have the same size, and all sheets of envelope paper also have the same size. Moreover, sheets of envelope paper are assumed to be larger than sheets of content paper. All sheets of content paper are of the same paper type, and all sheets of envelope paper are also of the same paper type. Further, sheets of content paper and sheets of envelope paper are of the same paper type.

In the transport control pattern corresponding to the one-side-one-side pattern, sheets of content paper and sheets of envelope paper are fed in original order to be spaced at predetermined sheet intervals and printed. In other words, sheets of content paper for a single letter are sequentially fed, and then a sheet of envelope paper is fed, the sheets being sequentially printed.

Figure 11:
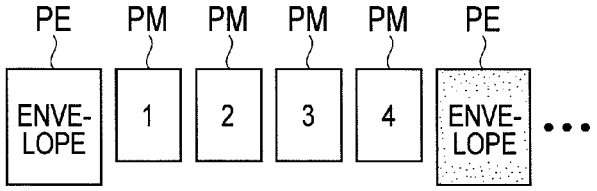
FIG. 11 is a view for explaining a transport control pattern corresponding to an one-side-double-side pattern.

In the transport control pattern corresponding to the one-side-double-side pattern, printing is performed in order such as shown in FIG. 11. In this transport control pattern, first, a sheet of envelope paper PE is fed. Subsequently, sheets (four sheets in the example of FIG. 11) of content paper PM for a single letter are sequentially fed to be spaced at predetermined sheet intervals. The fed sheets of envelope paper PE and content paper PM are sequentially printed. The sheet of envelope paper PE is printed on a front side thereof. Here, a number written in each sheet of content paper PM indicates the position of the sheet in order among the sheets of content paper PM for the single letter.

During the printing of the fed sheets of content paper PM, the sheet of the envelope paper PE printed on the front side thereof is transported to the reversing unit 16 and stands by at the switchback unit 47. The horizontal transport rollers 39 transport the sheet of envelope paper PE at maximum speed such that the sheet of envelope paper PE reaches the switchback unit 47 by the time that the feed of the sheets of content paper PM for the single letter is finished. The sheet of envelope paper PE standing by at the switchback unit 47 is re-fed behind the last sheet of content paper PM for the single letter to be spaced therefrom by a predetermined sheet interval, and printed on the back side thereof.

In the one-side-double-side pattern, in the case where printing is performed in original printing order, after sheets of content paper PM are printed, a sheet of envelope paper PE would be printed on the front side thereof and circulated to be printed on the back side thereof. On the other hand, in the transport control pattern described above with reference to FIG. 11, the sheets of content paper PM are printed while the sheet of envelope paper PE is being circulated. Accordingly, productivity can be improved compared to that for the case where printing is performed in original printing order.

Figure 12:
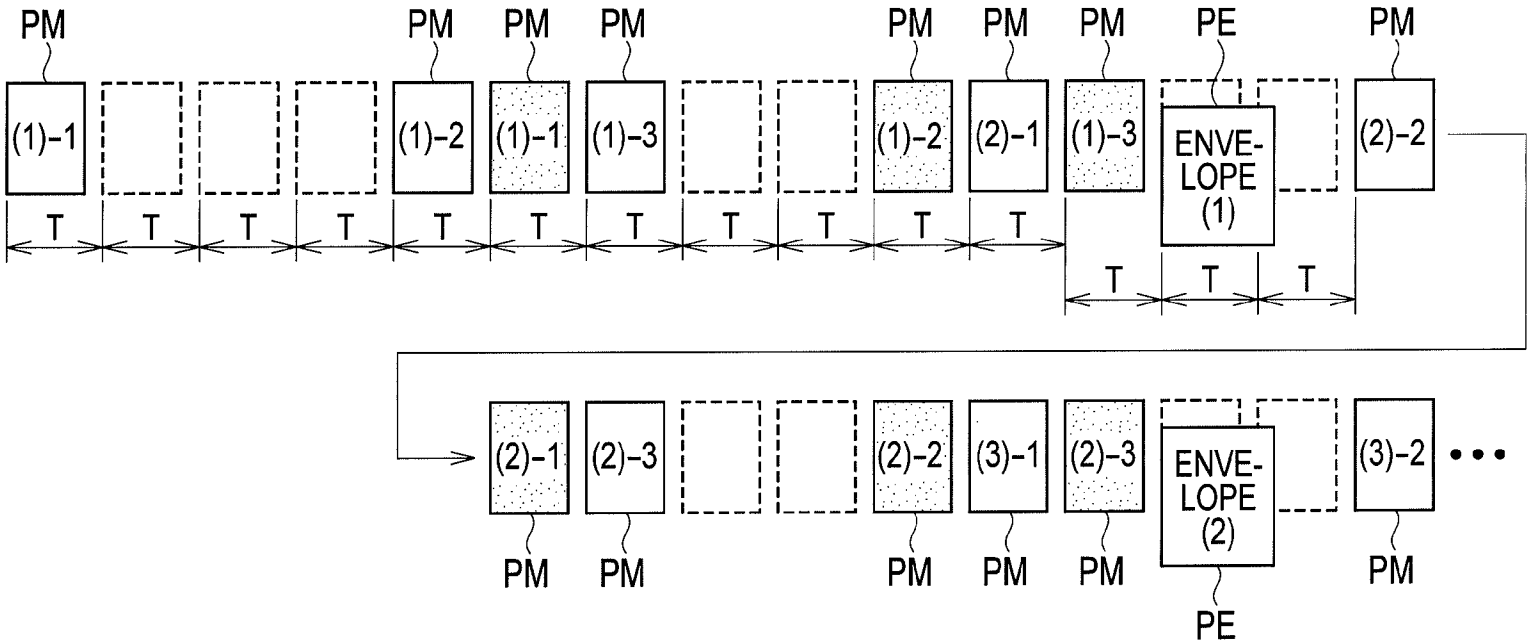
FIG. 12 is a view for explaining a transport control pattern corresponding to a double-side-one-side pattern.

In the transport control pattern corresponding to the double-side-one-side pattern, printing is performed in the order and with the timings shown in FIG. 12. Here, in FIG. 12, a number within parentheses indicates the position of the letter in the sequence of letters. Moreover, a number following a hyphen in a sheet of content paper PM indicates the position of the sheet in order among the sheets of content paper for the letter. In the example of FIG. 12, the number of sheets of content paper PM for a single letter is three.

In this transport control pattern, after a first sheet of content paper PM for a first letter is fed and printed on a front side thereof, a second sheet of content paper PM for the first letter is fed to be printed on a front side thereof after a pause equal to printing time 3T for three sheets of content paper. Subsequently, the circulated first sheet of content paper PM for the first letter is re-fed and printed on a back side thereof, and then a third sheet of content paper PM for the first letter is fed and printed on a front side thereof. After that, the circulated second sheet of content paper PM for the first letter is re-fed to be printed on a backside thereof after a pause equal to printing time 2T for two sheets. Subsequently, a first sheet of content paper PM for a second letter is fed and printed on a front side thereof, and the circulated third sheet of content paper PM for the first letter is re-fed and printed on a back side thereof. After that, a sheet of envelope paper for the first letter is fed and printed, and then a second sheet of content paper PM for the second letter is fed and printed on a front side thereof. This is repeated. Here, a time interval between the printing of the re-fed third sheet of content paper PM for the first letter and the printing of the second sheet of content paper PM for the second letter is set to printing time 2T for two sheets of content paper, and the printing of the sheet of envelope paper PE for the first letter is inserted therebetween.

In this transport control pattern, a sheet of content paper PM for a subsequent letter is printed prior to the printing of a sheet of envelope paper PE for a preceding letter. Specifically, for example, a front side of a first sheet of content paper PM for a second letter is printed prior to the printing of a sheet of envelope paper PE for a first letter. This can reduce idle time during printing and improve productivity compared to those for the case where the double-side printing of content paper PM and the one-side printing of envelope paper PE are sequentially performed on a letter-by-letter basis.

Figure 13:
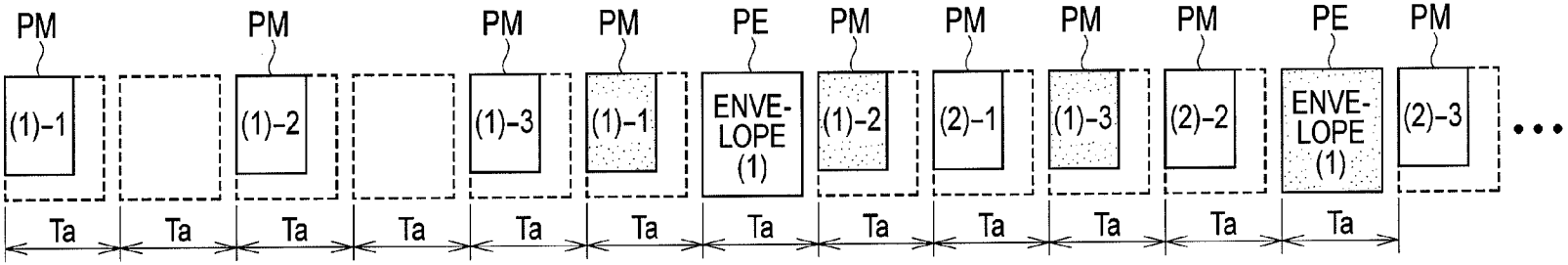
FIG. 13 is a view for explaining a transport control pattern corresponding to a double-side-double-side pattern.

In the transport control pattern corresponding to the double-side-double-side pattern, printing is performed in the order and with the timings shown in FIG. 13. FIG. 13 shows control which is performed as in FIG. 10 with reference to the size of a sheet of envelope paper PE. Accordingly, in this transport control pattern, after a first sheet of content paper PM for a first letter is printed on a front side thereof, a second sheet of content paper PM for the first letter is printed on a front side thereof after a pause equal to printing time Ta for a single sheet corresponding to the size of a sheet of envelope paper PE, and a third sheet of content paper PM for the first letter is printed on a front side thereof after another pause equal to printing time Ta for a single sheet. Subsequently, the circulated and reversed first sheet of content paper PM for the first letter is printed on a backside thereof. Further, a sheet of envelope paper PE for the first letter is printed on a front side thereof, and then the circulated and reversed second sheet of content paper PM for the first letter is printed on a back side thereof. After that, similarly, the printing of a front side of a newly fed sheet of content paper PM or envelope paper PE and the printing of aback side of a circulated and reversed sheet of content paper PM or envelope paper PE are alternately performed.

In printing for sealed letter formation, the controller 17 controls the timing of the feed of each sheet of paper by the paper feed unit 11, the transport speed of the horizontal transport rollers 39 of the upside transport unit 14, and the like according to the above-described transport control pattern corresponding to the printing pattern.

In the case where printing for forming plural sealed letters is consecutively performed, printing patterns may be changed between letters. In this case, transport control patterns are switched between letters. When an attempt is made to perform switching to a subsequent transport control pattern in a state in which sheets P for a letter according to a preceding transport control pattern are left on the transport route, a collision of sheets P, a paper jam, or the like may occur. Accordingly, in the case where transport control patterns are switched between letters, after all of the sheets P for the letter according to the preceding transport control pattern are sent out to the enclosing and sealing device 3, the controller 17 starts the feed of sheets P for a letter according to a subsequent transport control pattern. Thus, the switching of transport control patterns requires a certain processing time.

On the other hand, in the case where printing patterns are not changed between letters, the switching of transport control patterns is unnecessary. Accordingly, no processing time is spent on switching transport control patterns. Here, in the case where the numbers of sheets of content paper are changed between letters but where printing patterns are not changed, printing can be continued under similar control of paper feed and transport, and therefore the switching of transport control patterns is unnecessary.

Accordingly, in this embodiment, in the case where printing for forming plural sealed letters is consecutively performed, the controller 17 arranges the order of printing such that letters having the same printing pattern are successively printed.

A process for arranging the order of printing on a letter-by-letter basis in printing for sealed letter formation will be described with reference to the flowchart of FIG. 14.

Figure 14:
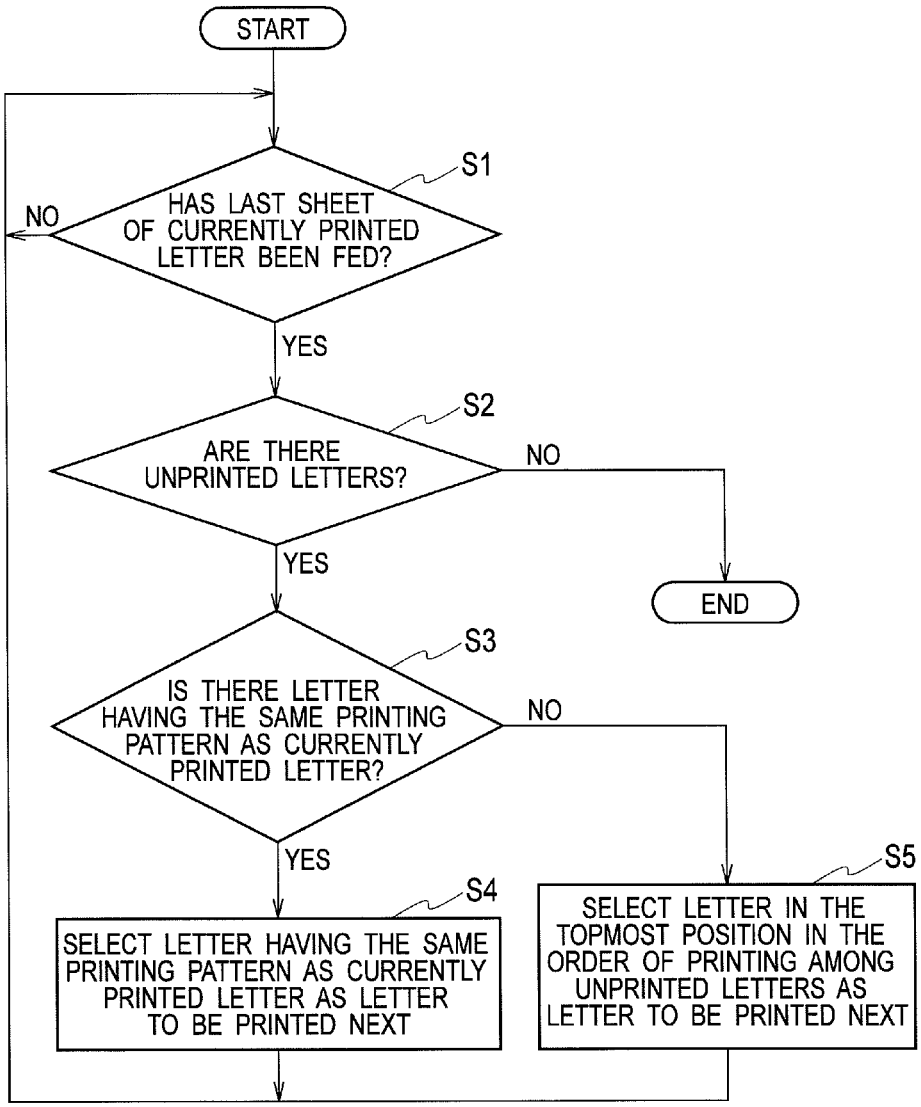
FIG. 14 is a flowchart of a process for arranging the order of printing on a letter-by-letter basis in printing for sealed letter formation.

A process shown in the flowchart of FIG. 14 is started by the printing machine 2 receiving a print job for sealed letter formation from an unillustrated PC (personal computer). In the print job for sealed letter formation, pieces of document data for respective letters are arranged. Moreover, the print job for sealed letter formation contains header information including printing pattern information for each letter.

Upon the receipt of the print job for sealed letter formation, the controller 17 first starts paper feed and printing based on document data for a letter in a first position in the order in which letters are arranged in the print job. Then, in step S1, the controller 17 determines whether or not a last sheet for the currently printed letter has been fed. If the controller 17 determines that the last sheet has not been fed yet (step S1: NO), the controller 17 repeats step S1.

If the controller 17 determines that the last sheet has been fed (step S1: YES), the controller 17 determines in step S2 whether or not any of the letters included in the received print job are unprinted.

If the controller 17 determines that there is one or more unprinted letters (step S2: YES), the controller 17 determines in step S3 whether or not the unprinted letter(s) include(s) one or more letters having the same printing pattern as the currently printed letter.

If the controller 17 determines that there is a letter having the same printing pattern as the currently printed letter (step S3: YES), the controller 17 sets the letter as a letter to be printed next, in step S4. Here, in the case where there are plural letters having the same printing pattern as the currently printed letter, the controller 17 selects among these letters the letter in a topmost position in the order in which the letters are arranged in the print job as a letter to be printed next. Then, the controller 17 starts the feed of paper for the next letter. At this time, since printing patterns are not changed, the switching of transport control patterns is not unnecessary. After step S4, the controller 17 returns to step S1.

If the controller 17 determines in step S3 that there is no letter having the same printing pattern as the currently printed letter (step S3: NO), the controller 17 selects in step S5 among the unprinted letters the letter in a topmost position in the order in which the letters are arranged in the print job as a letter to be printed next. Then, the controller 17 starts the feed of paper for the next letter. At this time, since printing patterns are changed, a process for switching transport control patterns occurs. After step S5, the controller 17 returns to step S1.

If the controller 17 determines in step S2 that there is no unprinted letter (step S2: NO), the controller 17 terminates processing.

Sheets of content paper and envelope paper printed in printing for sealed letter formation by the printing machine 2 are sent to the enclosing and sealing device 3. In the enclosing and sealing device 3, sheets of content paper for a single sealed letter sent from the printing machine 2 are aligned by the aligning unit 61, and the aligned sheets of content paper are folded by the content paper folding unit 62. When a sheet of envelope paper is sent from the printing machine 2, the envelope forming unit 63 forms the sheet of envelope paper into an envelope, and inserts the folded sheets of content paper into the envelope. After that, the sealing unit 64 seals the envelope to complete a sealed letter.

As described above, in the printing machine 2, in the case where printing for forming plural sealed letters is consecutively performed, the controller 17 arranges the order of printing such that letters having the same printing pattern are successively printed. This can reduce the number of times of the switching of transport control patterns. As a result, processing time required for the switching of transport control patterns can be reduced, and therefore printed matter productivity can be improved.

It should be noted that in the above-described embodiment, the paper types of content paper and those of envelope paper are the same in all of the letters. However, the letters may include a letter which has a different paper type for at least any one of content paper and envelope paper from that of other letters. In this case, printing patterns include combinations of paper types for content paper and envelope paper as well as combinations of one-side/double-side printing settings for content paper and envelope paper. In other words, in the case where letters have the same combination of one-side/double-side printing settings for content paper and envelope paper but where the letters have different paper types for at least any one of content paper and envelope paper, the controller 17 deals with these letters as letters having different printing patterns.

In the printing machine 2 of an inkjet type, a maximum number of ink droplets per pixel to be ejected from an inkjet head and the transport speed (printing transport speed) of the belt transport unit 31 during printing are controlled in accordance with the paper type of a sheet P. Specifically, for a paper type more resistant to ink bleed-through, the maximum number of ink droplets per pixel is made larger; and, for a paper type having a larger maximum number of ink droplets, the printing transport speed is made lower. Since the printing transport speed of the belt transport unit 31 is changed according to the paper type of a sheet P, the transport speed of, for example, the horizontal transport rollers 39 needs to be changed when paper types are changed, and therefore transport control patterns are changed. Accordingly, in the case where letters have different paper types for at least any one of content paper and envelope paper, the controller 17 deals with these letters as letters having different printing patterns, and performs the control of paper feed and transport according to the transport control patterns corresponding to the printing patterns. This can reduce a decrease in the productivity of the inkjet printing machine 2 with print quality maintained according to different paper types.

Moreover, in the above-described embodiment, all of the letters have the same sizes for content paper and envelope paper. However, the letters may include a letter having a different size for at least any one of content paper and envelope paper from that of other letters. In this case, printing patterns include combinations of sizes for content paper and envelope paper, and the controller 17 performs the control of paper feed and transport according to transport control patterns corresponding to printing patterns taking into account the sizes for content paper and envelope paper.

Moreover, in the above-described embodiment, upon the receipt of a print job for sealed letter formation, the controller 17 unconditionally arranges the order of printing based on the printing patterns of the respective letters. However, the arrangement of the order of printing may be performed only in the case where the effect of processing time required for the switching of transport control patterns on productivity is relatively large, e.g., the case where the number of letters included in the print job is larger than a reference value (case where a predetermined condition is satisfied). Here, in the case where the number of letters included in the print job is not more than the reference value (case where the predetermined condition is not satisfied), the letters may be printed in order from the letter in a topmost position in the order in which the letters are arranged in the print job. Thus, in the case of the printing of a small number of letters in which the effect of processing time required for the switching of transport control patterns on productivity is relatively small, sealed letters can be formed in the order in which the letters are arranged in the print job. It should be noted that in the above-described embodiment, the predetermined condition is no condition.

Moreover, in the above-described embodiment, a description has been made for the case of printing for sealed letter formation, each letter including two categories of paper, which are content paper and envelope paper. However, the unit of printing is not limited to a letter in printing for sealed letter formation, and the number of categories of paper is not limited to two.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing machine comprising:

a transport unit configured to transport a sheet along a circulating route including a reversing route;

a paper feeder configured to feed the sheet to the circulating route;

a printer configured to perform printing on the sheet transported along the circulating route;

a paper discharger configured to discharge the sheet from the circulating route; and a controller configured to control the transport unit, the paper feeder, the printer, and the paper discharger in response to a print job, such that for a sheet subject to one-side printing, the sheet is printed on one side thereof by the printer while being transported by the transport unit and then discharged by the paper discharger without entering the reversing route, and for a sheet subject to double-side printing, the paper is printed on one side thereof by the printer while being transported by the transport unit, then reversed on the reversing route, printed on the other side thereof by the printer, and then discharged by the paper discharger, and wherein the controller is further configured to, when printing a plurality of print units, each print unit including a plurality of categories of sheets having different sizes, is performed on a unit-by-unit basis, control a feed timing of each sheet by the paper feeder and a transport of the sheets by the transport unit according to a transport control pattern corresponding to a printing pattern, the printing pattern including a combination of one-side/double-side printing settings for the respective categories of sheets in each of the print units, and when the printing of the plurality of print units is consecutively performed and when a predetermined condition is satisfied, the controller is further configured to arrange an order of printing of the plurality of print units such that the print units having a same printing pattern and including sheets from at least two categories of sheets having different sizes, among the plurality of print units, are successively printed.

2. The printing machine according to claim 1, wherein the printer comprises an inkjet head configured to eject ink droplets onto the transported sheet, the printing pattern includes paper types for the respective categories of sheets in each of the print units, and the controller is configured to control a maximum number of the ink droplets per pixel to be ejected from the inkjet head onto the sheet and to control a transport speed of the sheet by the printer during printing, according to the paper type of the sheet.

3. The printing machine according to claim 1, wherein when the printing of the plurality of print units is consecutively performed and when the predetermined condition is not satisfied, the controller is configured to arrange the order of printing of the plurality of print units such that the plurality of print units are printed in order from the print unit in a topmost position in an order in which the plurality of print units are arranged in the print job.

4. The printing machine according to claim 1, wherein the predetermined condition is that a number of the plurality of print units is larger than a reference value.

5. The printing machine according to claim 1, wherein each print unit includes at least one sheet of content paper and a sheet of envelope paper having a size difference than a size of the content paper.

6. The printing machine according to claim 1, further comprising an enclosing and sealing device to which printed print units are discharged.

7. The printing machine according to claim 1, each print unit being defined as a specific ordered sequence of sheets to be printed.

8. A printing machine comprising:

a transport unit configured to transport a sheet along a circulating route including a reversing route;

a paper feeder configured to feed the sheet to the circulating route;

a printer configured to perform printing on the sheet transported along the circulating route;

a paper discharger configured to discharge the sheet from the circulating route; and a controller configured to control the transport unit, the paper feeder, the printer, and the paper discharger in response to a print job, such that for a sheet subject to one-side printing, the sheet is printed on one side thereof by the printer while being transported by the transport unit and then discharged by the paper discharger without entering the reversing route, and for a sheet subject to double-side printing, the paper is printed on one side thereof by the printer while being transported by the transport unit, then reversed on the reversing route, printed on the other side thereof by the printer, and then discharged by the paper discharger, and wherein the controller is further configured to when printing of plurality of print units, each print unit including a plurality of categories of sheets having different sizes is performed on a unit-by-unit basis, control a feed timing of each sheet by the paper feeder and a transport of the sheets by the transport unit according to a transport control pattern corresponding to a printing pattern, the printing pattern including a combination of one-side/double-side printing settings for the respective categories of sheets in each of the print units, and when the printing of the plurality of print units is consecutively performed, arrange an order of printing of the plurality of print units such that the print units having a same printing pattern and including sheets from at least two categories of sheets having different sizes, among the plurality of print units are successively printed.

9. The printing machine according to claim 8, wherein each print unit includes at least one sheet of content paper and a sheet of envelope paper having a size difference than a size of the content paper.

10. The printing machine according to claim 8, further comprising an enclosing and sealing device to which printed print units are discharged.

11. The printing machine according to claim 8, each print unit being defined as a specific ordered sequence of sheets to be printed.

* * * * *